United States Patent [19]

Lawrence

[11] Patent Number: 4,632,038

[45] Date of Patent: Dec. 30, 1986

[54] MONORAIL VEHICULAR SYSTEM

[76] Inventor: David L. Lawrence, 831 W. Gillam Ave., Langhorne, Pa. 19047

[21] Appl. No.: 605,591

[22] Filed: Apr. 30, 1984

[51] Int. Cl.[4] ..... B61B 13/06; E01B 25/08; B61C 13/08

[52] U.S. Cl. ..... 104/120; 104/288; 105/141; 191/22 R; 191/59.1; 238/10 E

[58] Field of Search ..... 104/118, 119, 120, 247, 104/288; 105/141, 144, 145; 238/10 R, 10 E; 191/22 R, 29 R, 59.1

[56] References Cited

U.S. PATENT DOCUMENTS

| | | | |
|---|---|---|---|
| 175,266 | 3/1976 | Banning | 105/141 |
| 494,081 | 3/1893 | Pruyn | 105/145 |
| 541,662 | 6/1895 | Fryer | 191/29 |
| 1,048,320 | 12/1912 | Koelle | 191/29 |
| 2,985,114 | 5/1961 | Lindner | 105/141 |
| 3,115,845 | 12/1963 | Girz | 104/119 |
| 3,461,811 | 8/1969 | Swinney | 104/118 |
| 3,610,162 | 10/1971 | Lawrence | 104/118 |
| 3,844,224 | 10/1974 | Ishii et al. | 104/247 X |
| 4,031,662 | 6/1977 | Beshany | 104/118 X |
| 4,034,678 | 7/1977 | Wilson | 238/10 R X |
| 4,044,688 | 8/1977 | Kita | 104/118 X |
| 4,217,727 | 8/1980 | Fetty et al. | 105/145 X |

FOREIGN PATENT DOCUMENTS

| | | | |
|---|---|---|---|
| 603469 | 6/1948 | United Kingdom | 104/247 |

*Primary Examiner*—Robert B. Reeves
*Assistant Examiner*—David F. Hubbuch

[57] ABSTRACT

A monorail vehicular system is provided, which uses an elevated track of multipiece construction, with a central electrically insulated panel having a supporting lower metal rail, which acts as one side of an electrical supply system, and with an upper metal rail on top of the central panel for support, and to provide the other side of the electrical system. The lower rail is supported at intervals by clips, carried on spaced vertical poles which rest on bases on the ground or other supporting surface. A car used in the system rides on wide roller type wheels on top of the upper metal rail, has a resiliently urged collector in contact with the upper rail, and a pair of contacts which engage the lower metal rail, with a pair of horizontal stabilizing wheels extending downwardly from the car on each side of the central panel and in contact with it, and which wheels are unequally spaced from the upper rail.

4 Claims, 9 Drawing Figures

MONORAIL VEHICULAR SYSTEM

BACKGROUND OF THE INVENTION

1. Field of the Invention

This invention relates to a monorail vehicular system of the single rail overhead or trolley track suspended variety, which can carry one or more vehicles thereon.

2. Description of the Prior Art

Monorail systems of the overhead track type have been very popular with traffic engineers, as they offer great potential for transporting large numbers of passengers at high speeds, and can be constructed to avoid the use or destruction of large quantities of land and to minimize construction costs.

The Pruyn U.S. Pat. No. 494,081 discloses an elevated railway car, that is carried by flanged wheels on an I-beam rail, and which has wheels F, which contact a rail for electrical power input to the car.

The Pruyn structure is not suitable for high speeds, does not provide a high degree of restraint on the track, and suffers from other problems.

The R. M. Fryer U.S. Pat. No. 541,662 discloses an elevated railway system which includes a suspended track, a driver or motor car carried on the track, the motor car being carried on trucks which engage the track. This structure which suspends the car below the track, does not provide a high degree of safety, would not permit of high speed operation and suffers from other shortcomings.

The H. H. V. Koelle U.S. Pat. No. 1,048,320 discloses a monorail car and traction mechanism, wherein the car rides on a narrow shaped rail 2 on the top of supporting posts 1, and has guide rails 3 on each side below the rail 2 which are engaged by guide wheels 19. The structure will not operate at high speeds, requires wide curves, and suffers from other shortcomings.

The S. E. Swinney U.S. Pat. No. 3,461,811 discloses a monorail system wherein the vehicle frame 10 is carried by wheels 14 on a single narrow rail 16. The frame carries two safety units, which each have a roller 30, one of which is on each side of the monorail beamway, and which move against the beamway by hydraulic pressure to stabilize the vehicles operation.

The Swinney structure is complicated, will not operate at high speeds or on sharp curves and suffers from other shortcomings.

The R. J. Lawrence U.S. Pat. No. 3,610,162 discloses a monorail system, which includes a single metal rail on top of a supporting central panel, and a lower metal rail having flanges on each side of the panel. The car rides on flanged wheels on top of the rail, with equally downwardly spaced pairs of wheels, bearing on the central panel for stabilizing the car. While this structure operates satisfactorily, it is not suitable for high speed operation, will not negotiate sharp curves and suffers from other shortcomings.

The system of my invention travels at speeds at least three times that of the apparatus of U.S. Pat. No. 3,610,162, will negotiate considerably sharper curves and has greater stability than previously available systems.

SUMMARY OF THE INVENTION

A monorail vehicular system of the overhead type is provided, which includes a track of multipiece construction with a metal top rail, a central electrically insulating panel, and a lower metal rail which is supported at intervals by clips which are carried on spaced vertical poles engaged in bases that rest on the ground or other supporting surfaces, the car used with the track has wide roller type wheels which ride on the top rail, a resilient metal collector plate also riding on the top rail, a pair of contacts engaging the lower rail to complete the electrical circuit and a pair of horizontal stabilizing wheels which are spaced unequally downwardly from the car, in contact with the central panel on each side to provide stability.

The principal object of the invention is to provide a monorail vehicular system which provides for safe high speed travel.

A further object of the invention is to provide a monorail vehicular system wherein the car can easily negotiate tight curves.

A further object of the invention is to provide a monorail vehicular system wherein improved electrical contact is obtained.

A further object of the invention is to provide a monorail vehicular system wherein improved stability of the car is provided.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
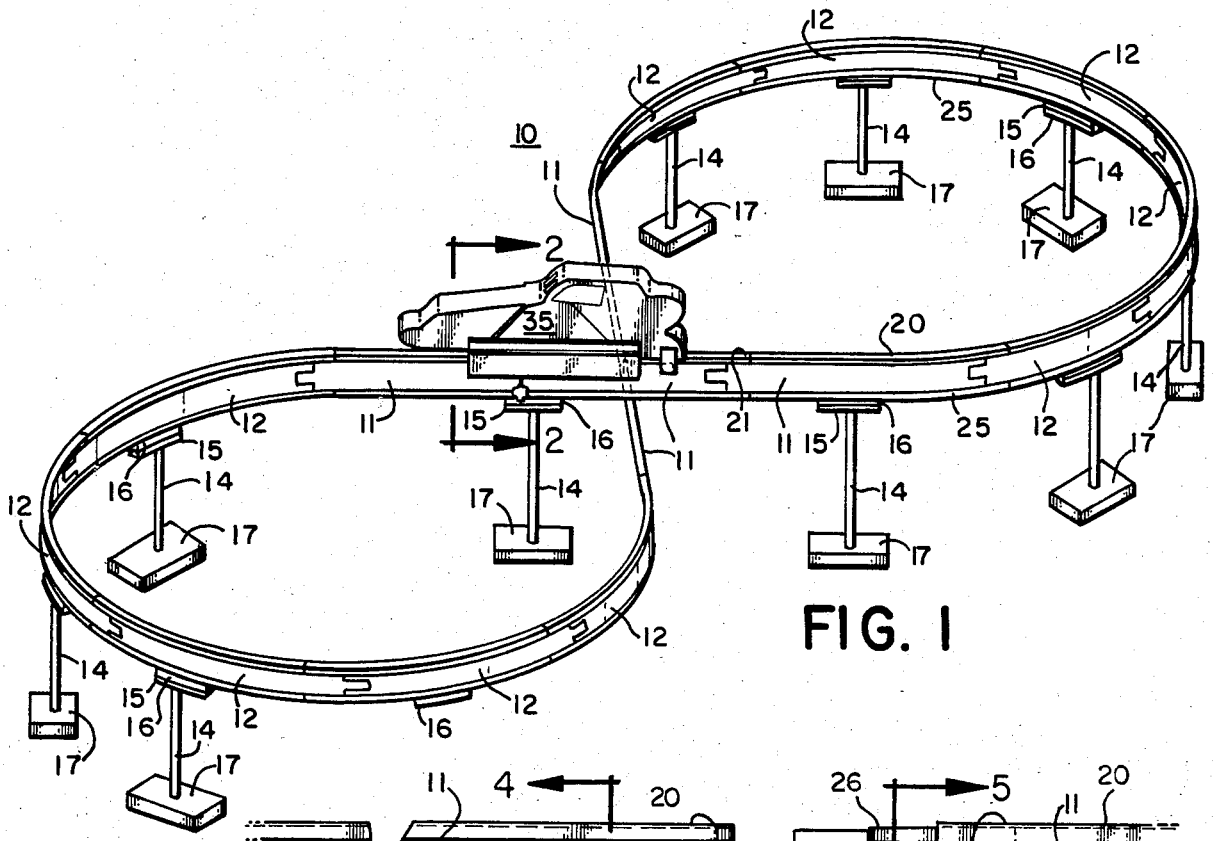
FIG. 1 is a view in perspective of the monorail vehicular system of the invention.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and the FIGS. thereof, the monorail vehicular system includes a track assembly 10, which is illustrated as including various straight and curved track sections 11 and 12, arranged in a figure eight configuration. The track assembly 10 is supported on a series of vertical poles 14, which have bars 15 that are engaged with clips 16, that are part of the track assembly 10. The poles 14 are carried in base plates 17, which can be mounted on or in the ground as desired.

Each track section 11 and 12 has a top metal rail 20, of rectangular configuration with an upper contact surface 21, the rail 20 being adhesively bonded or otherwise secured to a top face 22A of a central panel 22. The panel 22 is of rectangular configuration in cross section and is preferably formed of any suitable material, synthetic plastic being suitable and which has electrically insulating characteristics.

The panel 22 has a lower metal rail 23 on its bottom face 24, and which can be of the same configuration as rail 20, with contact faces 25 on each side thereof. The rail 23 can be adhesively bonded or otherwise secured to the bottom face 24 of the panel 22.

Figure 3:
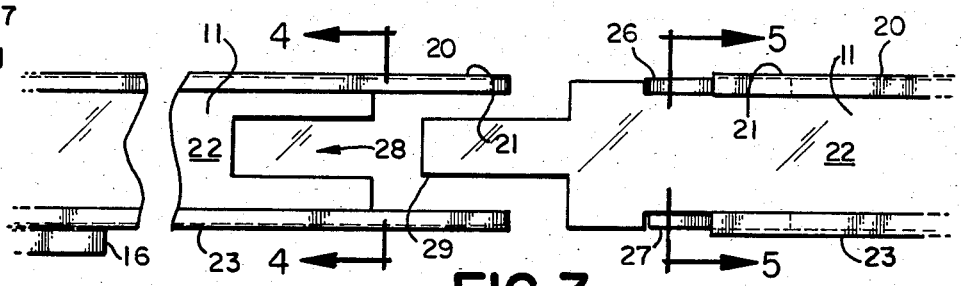
FIG. 3 is a fragmentary side elevational view illustrating a portion of a preferred form of track assembly of the invention.
Figure 2:
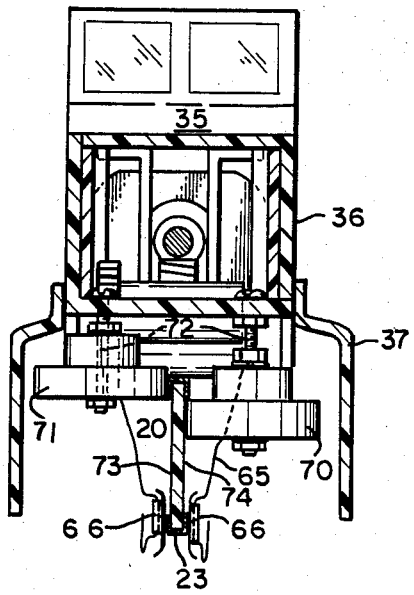
FIG. 2 is a vertical sectional view, enlarged, taken approximately on the line 2—2 of FIG. 1.
Figure 4:
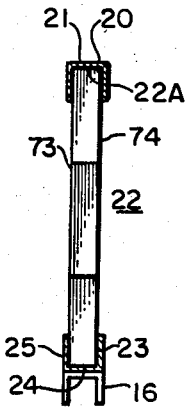
FIG. 4 is a vertical sectional view, enlarged, taken approximately on the line 4—4 of FIG. 3.
Figure 5:
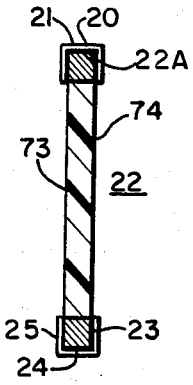
FIG. 5 is a view similar to FIG. 4 taken approximately on the line 5—5 of FIG. 3.
Figure 6:
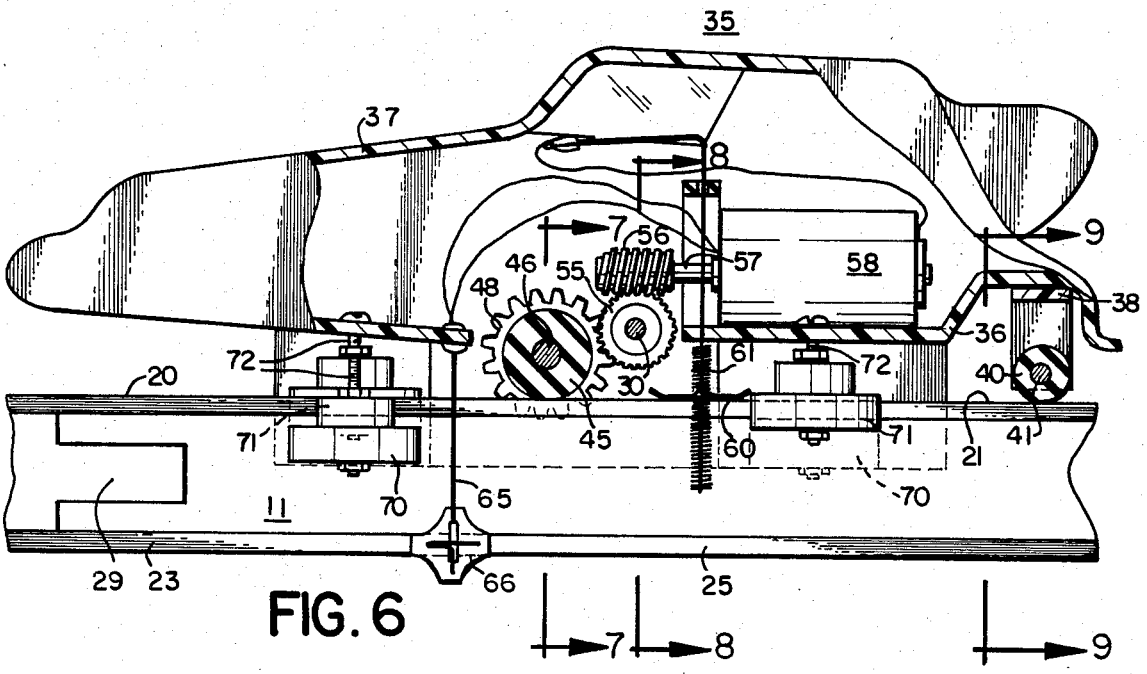
FIG. 6 is a side elevational view, enlarged, in partial section, illustrating the internal details of the system of FIG. 1.

As illustrated in FIGS. 3, 4, and 5, the top rail 20 and the lower rail 23 extend outwardly past the ends of the central panel 22, at the left hand side for each section of track 11 and 12, and the top rail 20 and lower rail 23 are recessed at the right hand side of panel 22. In addition, the top rail 20 and the lower rail 23 have connecting portions 26 and 27 which engage in the rails 20 and 23, from the rail section to the right thereof maintaining electrical connection therebetween. The central panel 22 at the left hand side, as seen in FIG. 3, has a cut-out portion 28 and the panel 22 at the right hand side has a tongue 29, which can engage respectively in the cut-out portion 28 as described above, to provide a continuous structure around the track 10.

The lower rail 23 has the clips 16 previously described, secured thereto at spaced intervals, and which are engaged with the bars 15 from the poles 14, providing support for the track sections 11 and 12.

A car or vehicle 35 is illustrated resting on the track assembly 10, which includes a frame 36 with an outer housing or body 37 detachably engaged therewith.

Figure 9:
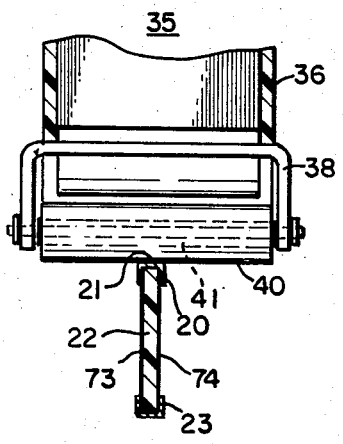
FIG. 9 is a fragmentary vertical sectional view, taken approximately on the line 9—9 of FIG. 6.

The frame 36 is provided with a U-shaped bracket 38 at the rear portion thereof, as shown in FIG. 9 which carries an idler roller 40 supported on a shaft 41, which is engaged in bracket 38 and which rotates therein. The roller 40 rides on the contact surface 21 of the top metal rail 20 and extends across the width of the car 35, so that the rail 20 can engage the roller at any point along its width permitting the car 35 to traverse sharp curves of track.

The roller 40 may be fabricated of any desired material with synthetic rubber of well known type being preferred, to provide for electrical insulation and to improve the operation of the car 35.

The frame 36, at approximately the midpoint of the car 35, has a driving roller 45 on a shaft 46 which is carried in bearings 47 which are mounted in side walls 44 of frame 36.

The roller 45 may be fabricated of material similar to roller 40 as desired.

Figure 7:
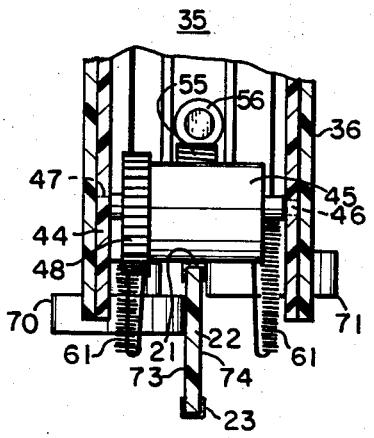
FIG. 7 is a fragmentary vertical sectional view, taken approximately on the line 7—7 of FIG. 6.

The shaft 46 at the left as seen in FIG. 7 has a gear 48 carried thereon which is engaged with a gear 49 of smaller diameter carried on shaft 50, in bearings 51 which are mounted in side walls 44 of frame 36.

The shaft 50 has a worm gear 55 thereon, adjacent to gear 49 and engaged with a pinion gear 56, which is secured to output shaft 57 of an electric motor 58 of well known type.

Figure 8:
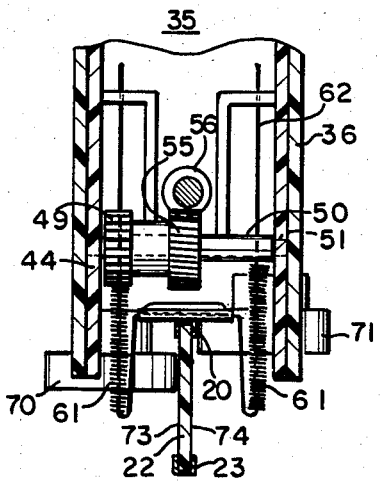
FIG. 8 is a fragmentary vertical sectional view, taken approximately on the line 8—8 of FIG. 6.

The electric motor 58 is mounted to frame 36 and is of the conventional type which has a ground through a spring urged collector plate 60 as seen in FIG. 8. The plate 60 is urged downwardly against contact surface 21 of rail 20, with two springs 61 secured to a metal frame 62, and on which the collector plate 60 is rotatably mounted, the springs 61 being secured thereto between it and the bottom of car frame 36.

The metal frame 62 is attached to the ground side of motor 58 by a wire (not shown) in conventional manner.

The electric motor 58 is also provided with a pair of collectors 65, which extend down the sides of panel 22, and have rotatable collector plates 66 which engage the contact faces 25 to complete the positive side of the electrical supply for the car 35.

The frame 35 has a pair of front and rear car guiding wheels 70 and 71, rotatably mounted by shafts 72 secured to the frame 35, and on which the wheels 70 and 71 are adjustably mounted in unequal spacing below the top rail 20.

The wheels 70 and 71 are in a horizontal plane and bear against either side 73 and 74 of panel 22 to restrain the car 35 from unwarranted sidewise movements and to restrain it from vertical rotational movement.

It will thus be seen that structure has been provided with which the objects of the invention are achieved.

I claim:

1. A monorail vehicular system for transporting vehicles on a track assembly, which is spaced above a supporting surface, the improvement which comprises a track assembly having a metal top rail with a contact surface, a rectanguarly shaped central panel of electrically insulating material to which said top rail is secured, a lower metal rail secured to said central panel at the bottom thereof and having contact faces on each side, a plurality of clips engaged with said lower rail and with bars carried on upright posts to support said rail from below, said vehicle having a frame which is disposed above and along said top rail, an idler roller at the rear of said vehicle rotatable mounted to said frame in contact with said top rail contact surface, of greater width than said rail and of substantially the same width as said frame, a driving roller mounted to said frame in contact with said contact surface of said top rail, and of substantially the same width as said idler roller, said idler roller and said driving roller being formed of electrically insulating material, at least one pair of horizontally disposed, vertically spaced, stabilizing wheels mounted on vertical shafts secured to said frame at the front of said vehicle, and engaging opposite vertical side faces of said central panel, and at least one pair of horizontally disposed, vertically spaced, stabilizing wheels mounted on vertical shafts secured to said frame at the rear of said vehicle, and engaging opposite vertical side faces of said central panel.

2. A monorail vehicular system as described in claim 1 in which a motor is provided carried by said frame and in driving relation with said driving roller.

3. A monorail vehicular system as defined in claim 1 in which said roller insulating material is synthetic rubber.

4. A monorail vehicular system as defined in claim 1 in which a collector plate is connected to said frame and is resiliently urged into contact with said contact surface of said top rail, and at least one collector extending down the sides of said central panel and having a collector plate in contact with a contact face of said lower metal rail.

* * * * *